United States Patent [19]

Watson

[11] 4,022,128

[45] May 10, 1977

[54] LAND MINE

[75] Inventor: Jack H. Watson, Los Angeles, Calif.

[73] Assignee: The United States of America as represented by the Secretary of the Navy, Washington, D.C.

[22] Filed: Dec. 23, 1960

[21] Appl. No.: 78,189

[52] U.S. Cl. ..... 102/19.2; 102/18 M; 102/70.2 R

[51] Int. Cl.[2] ..... F42C 11/00

[58] Field of Search ..... 102/18, 70.2, 19.2; 200/61.01, 61.45

[56] References Cited

UNITED STATES PATENTS

| | | | |
|---|---|---|---|
| 2,161,416 | 6/1939 | Heck et al. | 200/61.01 |
| 2,396,699 | 3/1946 | Hayes et al. | 200/61.01 |
| 2,766,345 | 10/1956 | Criter | 200/61.45 |
| 2,801,589 | 8/1957 | Meek et al. | 102/70.2 |
| 2,825,863 | 3/1958 | Krupen | 102/70.2 |
| 2,892,403 | 6/1959 | Glennon et al. | 102/18 |
| 2,906,206 | 9/1959 | Morison et al. | 102/70.2 |
| 2,958,280 | 11/1960 | Gilfillan et al. | 102/18 |
| 2,961,502 | 11/1960 | Hester | 200/61.01 |
| 2,966,853 | 1/1961 | Gilfillan, Jr. et al. | 102/18 |
| 2,979,582 | 4/1961 | Weaver | 200/61.45 |
| 2,998,774 | 9/1961 | Gibson | 102/70.2 |
| 3,010,395 | 11/1961 | Maltby | 102/18 |
| 3,035,521 | 5/1962 | Hynard | 102/70.2 |

*Primary Examiner*—Charles T. Jordan

EXEMPLARY CLAIM

1. A detonating circuit comprising a coil responsive to an external magnetic field, a vibration responsive switch connected in parallel with said coil having a closed position and an open position, said switch responsive to external vibration for vibrating between said open and closed positions, an electronic amplifier coupled to said switch and to said coil and biased to provide constant amplitude pulses having periods equal to the vibration rate of said switch, an impulse forming circuit coupled to said amplifier having means for storing a predetermined number of said pulses, an explosive primer, means coupled to said impulse forming circuit and to said primer for actuating said primer when an impulse of predetermined energy is generated in response to the receipt of said predetermined number of pulses.

8 Claims, No Drawings

INVENTOR.
JACK H. WATSON
BY W. O. Duesenberry
O. Hodges
Allen M. Lowe
ATTYS.
AGT.

INVENTOR.
JACK H. WATSON

BY W. O. Duesenberry
A. C. Hodges
Allan M. Lowe
ATTYS.
AGT.

INVENTOR.
JACK H. WATSON
BY W. O. Duesenberry
D. Hodges
Allan M. Lowe
ATTYS.
AGT.

INVENTOR.
JACK H. WATSON

BY W. D. Duesenberry
O. D. Hodges
Allan M. Lowe
ATTYS.
AGT.

LAND MINE

This invention relates to land mines that are responsive to vehicle influences and more particularly to such mines that are to be dropped on the ground from the air.

This invention also relates to an inertial responsive switch which may be used as a safety element in an air-dropped, land mine.

In addition, this invention concerns a vibration responsive switch which may be utilized on a land mine.

This invention also relates to a novel electronic circuit used to actuate a load which preferably is a detonating device in a mine explosive train.

Prior land mines have suffered many disadvantages associated with their planting in enemy territory because of the resulting ease with which they could be detected. Also, many prior land mines rely on contact with an enemy vehicle to detonate them thereby rendering them inoperative when such vehicles merely come in proximity therewith.

Accordingly, it is an object of this invention to provide a new and improved land mine.

A further object of this invention is to provide a new and improved land mine that may be dropped from an aircraft.

It is an additional object of this invention to provide a new and improved influence responsive land mine which may be dropped from an aircraft.

Another object of this invention is to provide a land mine responsive to seismic vibrations and magnetic influeneces.

It is a still further object of this invention to provide a new and improved inertial switch.

A further object of this invention is to provide a new and improved vibration responsive or seismic switch.

Another object of this invention is to provide a new electronic circuit which will actuate a mine when a vehicle is directly above it.

Various other objects and advantages will appear from the following description of one embodiment of the invention, and the novel features will be particularly pointed out hereinafter in connection with the appended claims.

The aforementioned objects will be achieved by a novel vibration responsive switch which is connected to a search coil responsive to a magnetic field. The resulting signal detected by the search coil will be fed to novel electronic apparatus designed to trigger an explosive train, when the vehicle producing the magnetic field and the seismic vibrations is directly above the mine, thereby knocking out the vehicle. The electronic circuit includes a two-stage a.c. amplifier, the first stage of which is connected to the vibration responsive switch and the search coil. The second stage includes a limiter and is coupled to a rectifying circuit. The output of the rectifying circuit is coupled to a pulse shaper which in turn is connected to a thyratron firing circuit. The firing circuit is coupled to an explosive primer which actuates the explosive train.

In operation, the electronic circuit is rendered inoperative until the mine vehicle strikes the ground because of a novel inertial switch employed. This switch is responsive to the total kinetic energy, rather than the instantaneous acceleration, applied to the mine as it drops to the ground. It comprises an inertial weight which is normally retained by a coil spring. When the switch hits the ground, the inertial weight strikes a shearing member which is designed to cut an electrical wire thereby permitting actuation of the explosive primer and the thyratron firing circuit.

The unique vibration responsive or seismic switch employed in this mine comprises a free mass which is suspended by a suitable wire. The mass carries an electrical switch contact which vibrates back and forth between a pair of fixed contacts when a moving vehicle is in proximity to the mine. This apparatus is rendered inoperative until the mine vehicle has struck the ground so that the piano wires will not break upon impact.

Reference is now made to the following description taken in connection with the accompanying drawings in which.

In the detailed description of this invention like reference numerals designate like or corresponding parts throughout the several figures.

Figure 1:
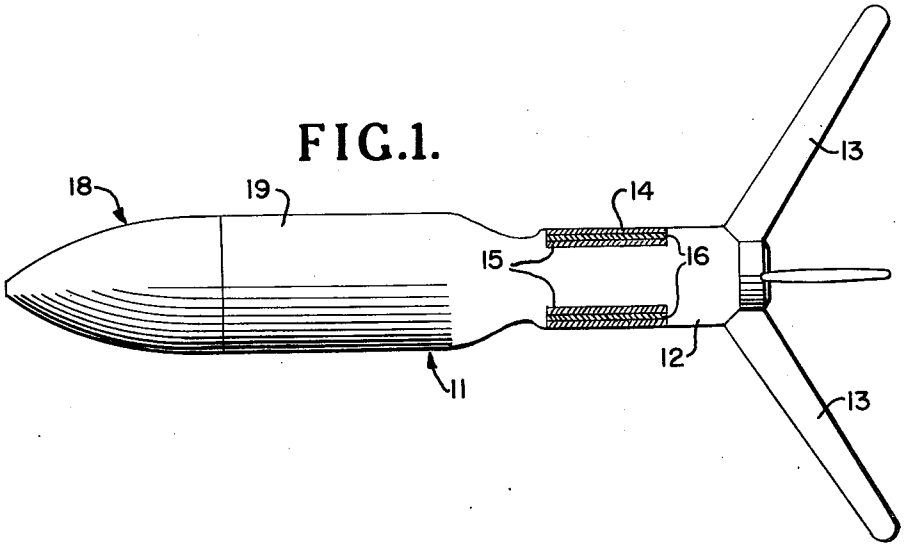
FIG. 1 is an overall view of the entire mine.

Referring now to FIG. 1 of the drawings, there is shown a mine body 11 having a mid or central portion 19 wherein the explosive charge is stored. Fins 13 insure aerodynamic qualities of the mine while it is dropping through the air and are secured to the tapered body portion 12, which is located to the rear of central portion 19. Search coil 16 which detects changes in the local magnetic field is located on the tapered body portion 12 just to the rear of the mid section of the mine. The coil 16 is covered by insulation 14 on the exterior of the mine and a circular shield 15 is in proximity to the interior circumference of the circular pickup coil. Search coil 16 is electrically connected to the nose of fuze portion 18 of the mine by way of suitable leads (not shown).

When the mine vehicle 11 is dropped from the air it will enter the ground with nose portion 18 first. The mine will strike the ground with sufficient force to bury itself in most cases. When a magnetic vehicle moves in proximity to the mine, search coil 16 will detect the resulting change in the earth's magnetic field and a voltage will be generated therein which is fed to fuze 18 by way of a wire (not shown). This voltage is utilized as one of the prime influences to actuate the fuze mechanism.

Figure 2:
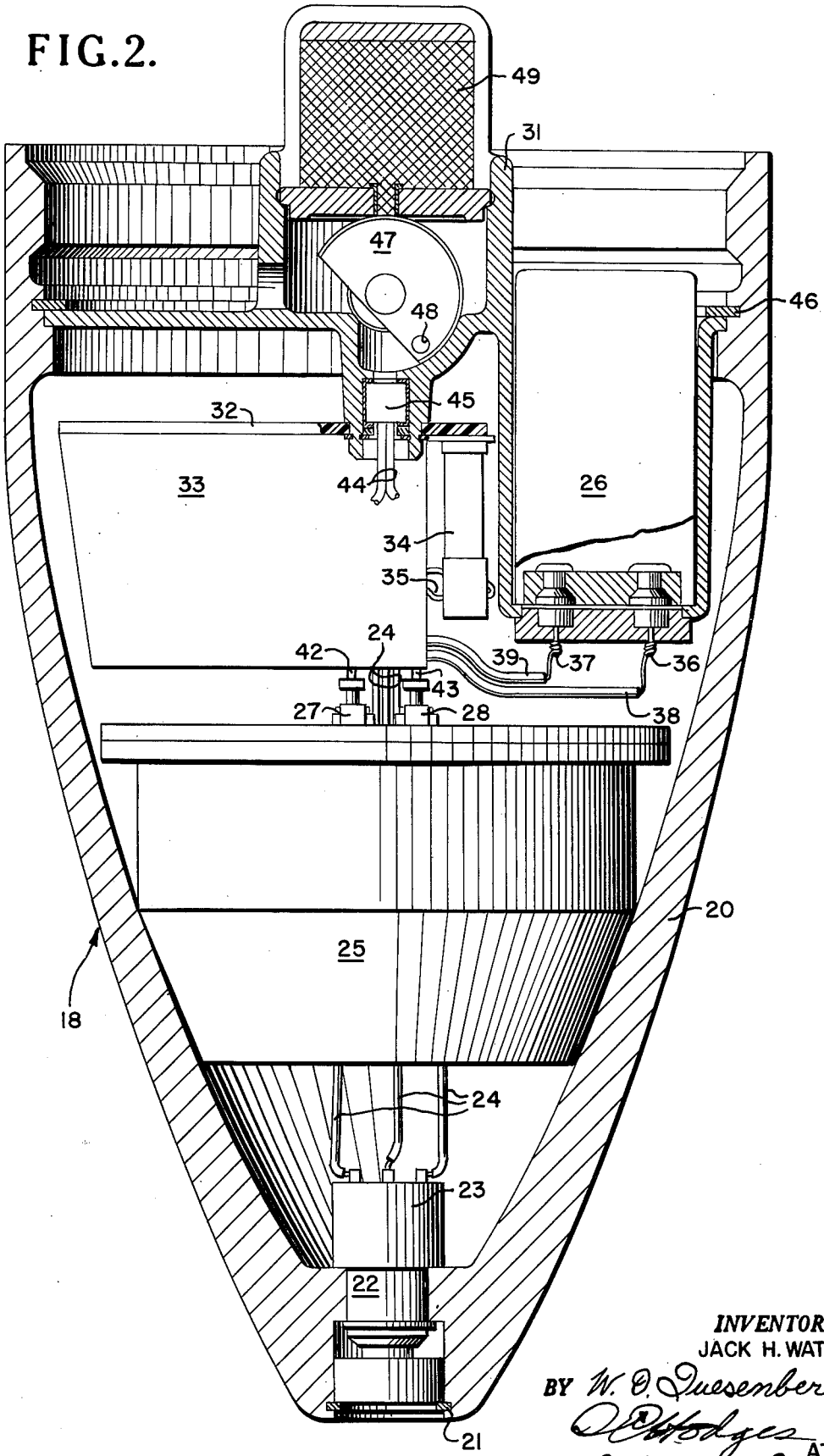
FIG. 2 is a sectional view of the nose portion of the mine shown in FIG. 1.

The fuze or nose portion 18 of the mine is shown in the sectional view of FIG. 2. The fuze 18 has an exterior shell 20 in which a plunger 22 is inserted at the nose or front end. The plunger 22 is held in place by a suitable means such as "C" ring 21. The plunger 22 actuates switch 23 due to impact forces when the mine hits the ground, in a well known manner. Leads 24 electrically connect the switch apparatus 23 to an electronic assembly 33 located in the rear portion of the fuze and mounted on base 32, which is made of suitable electrical insulating material, such as plastic.

Vibration switch 25 is secured in the forward end of the fuze between switch 23 and electronic assembly 33 and is held in place by any suitable means which may be set screws. This vibration or seismic switch is connected electrically to the electronic assembly 33 by way of suitable wires 42 and 43 that are connected to terminals 27 and 28, respectively.

Power supply or battery 26 is located adjacent to electronic assembly 33 and the base upon which that assembly is secured. The battery is connected to assembly 33 by way of leads 38 and 39 which are respectively coupled to the terminals 36 and 37 of the battery 26. Inertial safety switch 34 is secured to base 32 by any suitable means and is electrically connected to the electronic assembly 33 by wire 35 which is coupled to the top of the safety switch.

Explosive primer 45 is located beneath base 32 upon which the electronic assembly is situated electrically connected to the electronic assembly by means of wires 44. The primer 45 communicates by way of rotor 47 with the explosive booster 49 when the fuze is in its actuated position. Prior to the time when the fuze is dropped from the aircraft the rotor is maintained in its unarmed position, as shown by a safety wire inserted through the hole 48 in rotor 47. When the mine is dropped from the air, the safety wire is pulled from the hole and the primer is lined up with the booster since the rotor is forced into position by a suitable spring, as is well known in the art.

The batteries 26, base 32, primer 45, rotor 47 and booster 49 are all secured in place by suitable means, such as the support member 31. The entire assembly is held in place by an appropriate element, which preferably is a support ring 46 extending around the circumference of shell 20.

Figure 3:
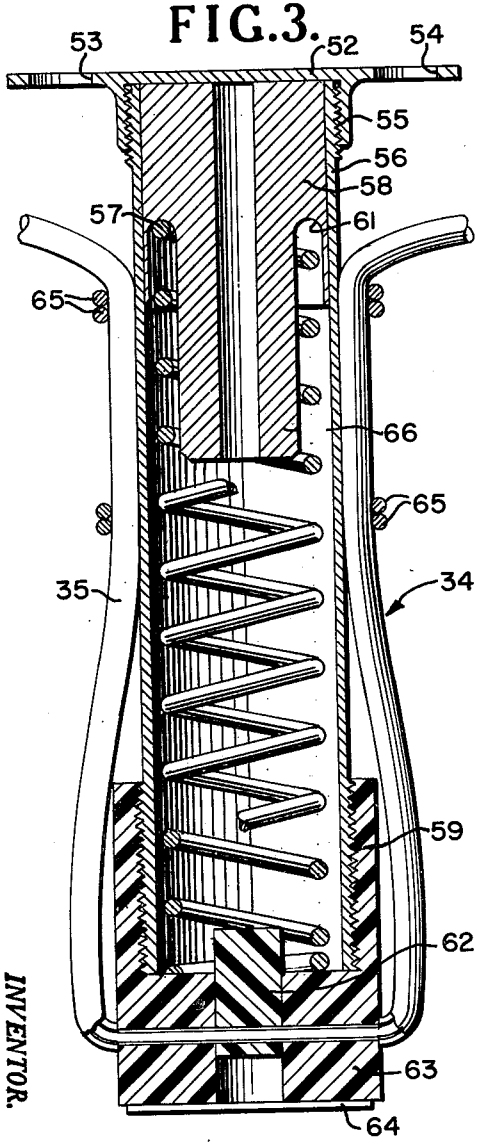
FIG. 3 is a sectional view of the unique inertial switch herein employed.

Fig. 3 of the drawings discloses the unique inertial, normally closed, safety switch herein employed, prior to its actuation. This apparatus is held in position on base 32, shown in FIG. 2, by suitable fastening means inserted in holes 53 and 54 in the base 52 of the switch assembly. Cylinder 56 is secured to base 52 by threads 55. Thus, when the mine vehicle is falling to earth the respective position of the inertial switch assembly is as shown in the figure, i.e., with cap 63 pointed downward. Inertial mass or piston 58 is normally supported in the position shown by coil spring 57 which communicates at its lower end with the cap 63 of this switch assembly. Cap 63 has a bore in which the shearing member 62 is fitted and is connected physically to cylinder 56 by any suitable means, such as threads 59. Both cap 63 and shearing member 62 have a small longitudinal hole therein within which wire 35 is to be inserted and are preferably composed of an insulating material, such as Teflon. Wire 35 is secured to the exterior of the switch apparatus, that is, to the outside wall of cylinder 56 by some suitable means, such as tie cords 65. Cap 63 is covered with a retaining element, adhesive tape 64 so that shearing member 62 will not be dropped completely from the switch assembly when wire 35 is broken.

In the operation of this swtich, inertial mass or piston 58 will initially be forced against base 52 by spring 57. When the mine vehicle strikes the ground, the inertial mass will compress the spring 57 and the extended portion 66 thereof will strike member 62 which in turn will break that portion of wire 35 which extends through the hole in the shearing member. When the wire is broken, a short circuit is removed across the electrical element which is to be energized.

Coil spring 57 is designed to have sufficient inertia so that instantaneous acceleration forces of considerably large magnitudes applied to the switch will not cause the piston 58 to sufficiently compress the coil spring. The forces must be applied to the inertial switch for a finite period of time rather than an instantaneous period of time to enable the extended portion 66 to strike the shearing member 62. Thus, for example, if the inertial switch is dropped from a distance of 40 feet on a steel plate causing a force of 20,000 gs to be instantly exerted on the assembly, the switch will not be actuated; but if the switch is dropped from a height of 1,000 feet from the air into soil with a resulting force of less than 1,000 gs the switch will be actuated.

Figure 4:
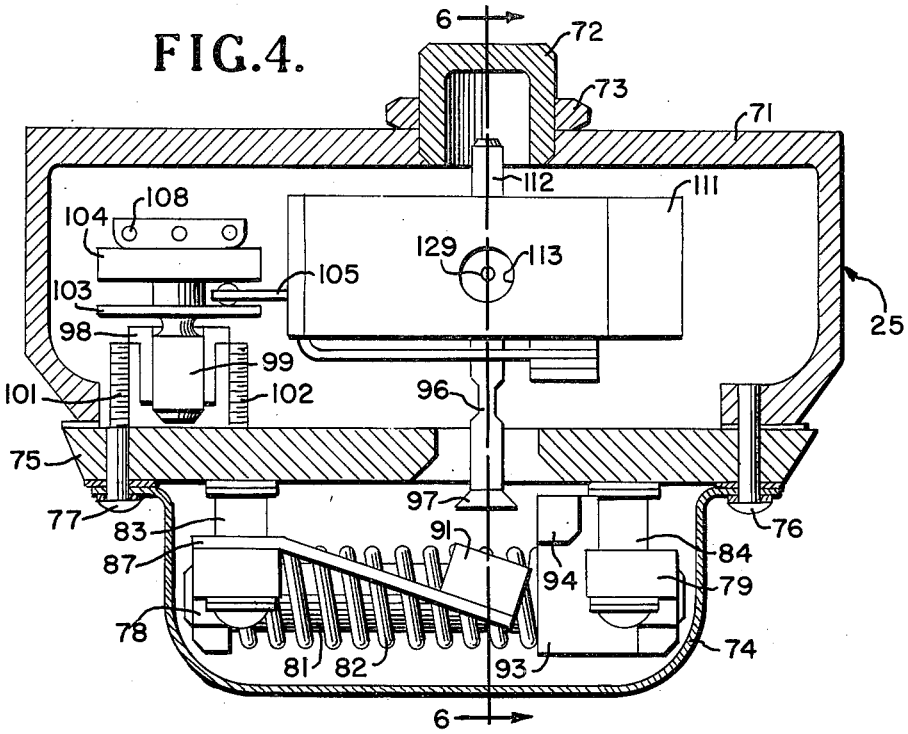
FIG. 4 is a sectional view of the novel seismic switch after the mine has struck the ground.

Referring now to FIG. 4 of the drawings, there is shown a sectional view of the seismic switch 25 after the mine has been dropped into the soil, i.e., when it is to be responsive to vibrations in the earth. The switch has an exterior shell 71 upon which a cover 72 is secured in place by nut 73. This structure is held in place within the fuze in such a manner that cover 72 is facing the electronic assembly and top 74 is directed toward the front end where the plunger switch apparatus is located. Shelf 75 is secured between top 74 and exterior shell 71 by screws 76 and 77 which are inserted in appropriate bores. Housings 78 and 79 are secured to shelf 75 by four screws of which two, 83 and 84, are shown in this figure. A shaft 81 carrying a coil spring 82 is located between the housings 78 and 79. A pair of torsion bars, 87, 88 (FIG. 6) is secured to the top of housing 78. Weights 91, 92 are secured to each of the torsion bars 87, 88, respectively. Subsequent to impact of the mine vehicle spring retaining member 93 is forced against housing 79 by coil spring 82.

Figure 6:
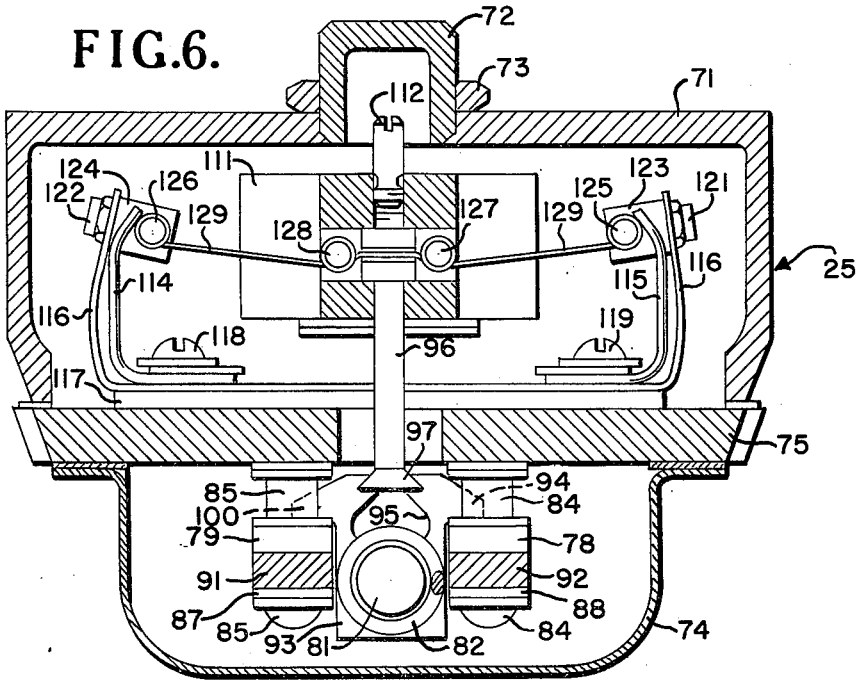
FIG. 6 is a sectional view of the seismic switch taken along the lines 6—6 of FIG. 4.

The relative position of these members is best shown in FIG. 6 of the drawings, which is a sectional view of FIG. 4 taken through the lines 6—6. Weights 91 and 92, which are carried by torsion bars 87 and 88, respectively, straddle shaft 81 and spring 82, as do screws 84 and 85. Prior to impact of the switch mechanism, shaft 96 secures free mass 111 in place, since the flange 97 of shaft 96 to which the free mass is secured is maintained within cavity 95 of retaining member 93. In addition, the position of flanges or protruding parts 94 and 100, on either side of retaining member 93, with respect to weights 91 and 92 is to be noted.

Figure 5:
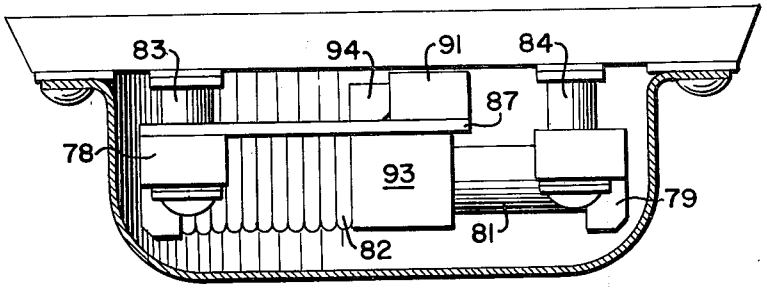
FIG. 5 is a partial sectional view of the seismic swtich prior to the time that the mine has struck the ground.

FIG. 5 is a partial view of the lower part of the apparatus shown in FIG. 4 prior to impact of the mine vehicle with the ground. When the seismic switch is in this position, shaft 96 maintains mass 111 in a fixed position since the flange 97 engages the cavity 95 of spring retaining member 93. The flanges 94 and 100 on spring retaining member 93 are secured in place by weights 91 and 92, respectively, which are located on the torsion bars. Accordingly, spring 82 is tightly coiled between member 93 and housing 78.

When the seismic switch is dropped to the ground, the weights 91 and 92 will exert sufficient torque on the torsion bars 87 and 88, respectively, so as to cause the bars to assume the bent position shown in FIG. 4. The weights are forced down sufficiently so that they no longer contact protruding members 94 and 100 of spring retaining member 93. Accordingly, coil spring 82 forces member 93 against housing 79, thereby freeing flange 97 from the cavity 95. Mass 111 is thus permitted to freely respond to seismic vibrations applied to the mine apparatus.

Referring now again to FIG. 4 of the drawings, screws 101 and 102 support a bushing 98 to which a shaft 99 is secured by any appropriate means. The shaft 99 carries a pair of electrical contacts 103 and 104 and is made of some appropriate conducting material so that the two contacts carried thereby are electrically connected together. Electrical terminal board 108 attached to contact 104 electrically couples contacts 103 and 104 to one of the terminals 27 and 28 shown in FIG. 2 by suitable lead wires (not shown). Armature 105 having a pair of tits is arranged underneath free mass 111 to a terminal 109. The terminal 109 is likewise electrically connected to one of the terminals 27 or 28 by way of wires coupled to one of the terminals on board 108.

Figure 7:
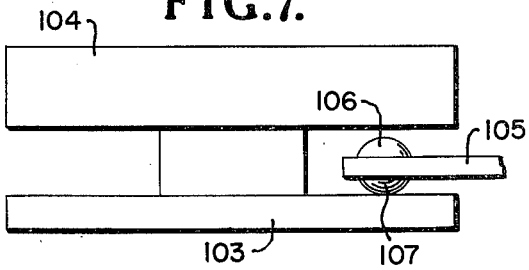
FIG. 7 is a greatly enlarged view of the switch and its associated contacts.

One of the tits carried by armature 105 touches the lower contact 103 while the other tit is spaced from the upper contact 104. This construction is best shown in greatly enlarged form in FIG. 7 wherein the tit 107 touches contact 103 and tit 106 is spaced from contact 104. Thus, an electrical circuit is normally formed between armature 105 and contact 103. The sensitivity of this seismic switch can be varied by adjusting screws 101 and 102 thereby controlling the force with which contact 103 bears on tit 107. It is to be understood that upper contact 104 is not essential to operation of this switch but that it is utilized to insure rapid electrical connections when the free mass is vibrating.

Adjusting screw 112 is carried on weight 111 so as to control the sensitivity thereof. This screw can be reached when cover 72 is removed.

Referring now more specifically to FIG. 6 of the drawing wherein piano wire 129 is shown as extending between wire assemblies 123 and 124 and screws 127 and 128 which are carried on free mass or weight 111. The piano wire communicates with the interior portion of the free mass by means of a bore 113 shown in FIG. 4. Screws 125 and 126 are carried on wire assemblies 123 and 124, respectively, which are secured to opposite arms of leaf spring 116. The central portion of leaf spring 116 is supported on base member 117 and is secured in place by screws 118 and 119. A pair of retaining members 114 and 115 are also held in place by these screws 118 and 119. These retaining members each have a groove therein so that wire assemblies 123 and 124 are fitted therein. These wire assemblies are secured to the leaf springs by way of screws 121 and 122. The retaining members prevent leaf spring 116 from folding into the center when the mine vehicle is dropped on the ground from the air. This spring has a natural frequency of vibration of less than 10 cycles per second and accordingly will not respond to vibrations created by the actuating vehicles. The natural frequency of the free mass is approximately 90 cycles per second. Thus there will be no resonant frequencies of the entire system which will cause very great oscillations of the free mass. When an exciting vibrational force is in the vicinity of this seismic switch, the free mass 111 will oscillate sufficiently however to cause tits 106 and 107 on armature 105 to engage contacts 103 and 104. Thus, piano wire 129 may be considered as a means to freely suspend mass 111 in a plane perpendicular to a component of the transmitted vibrations.

Figure 8:
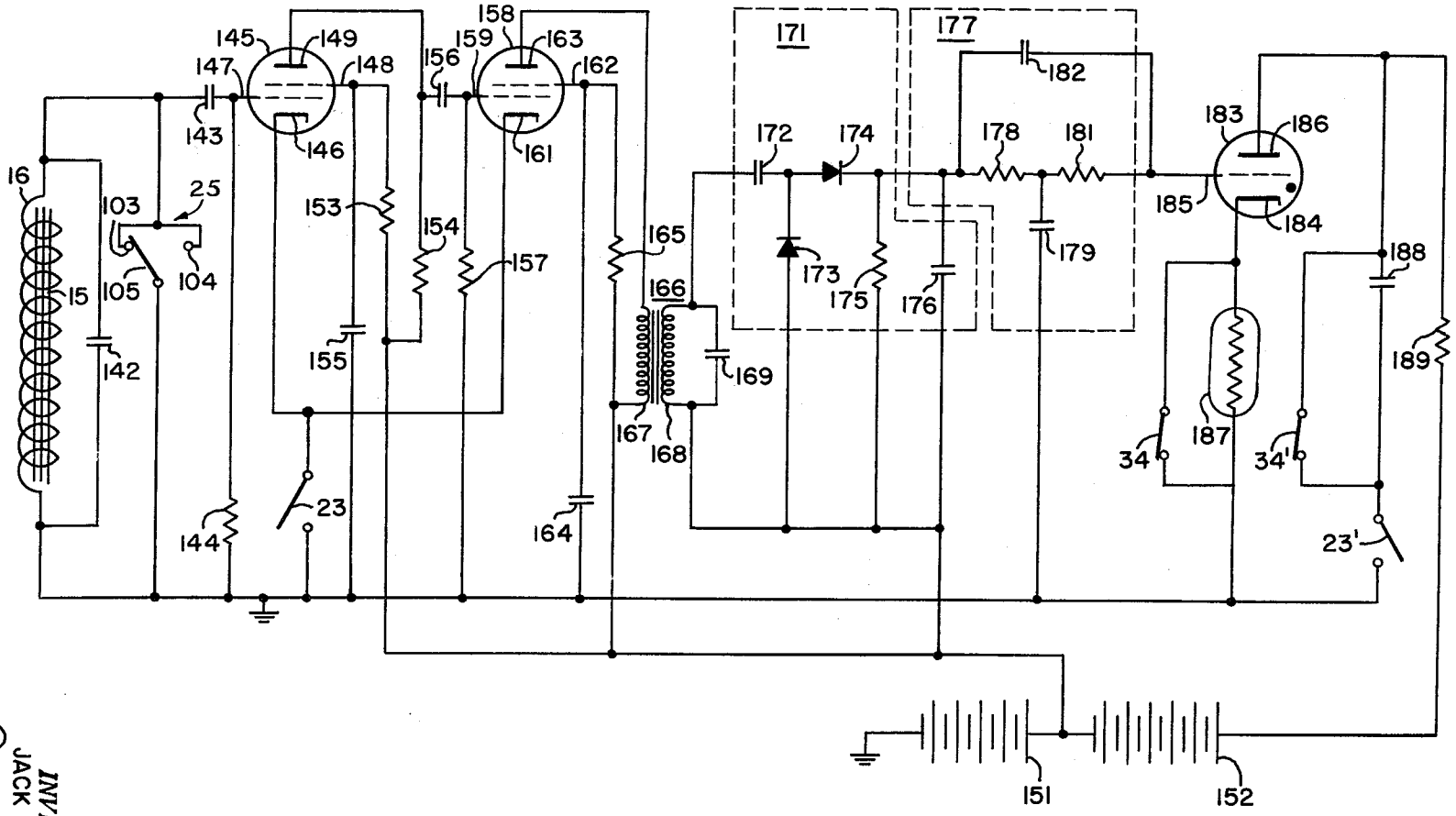
FIG. 8 is a schematic diagram of the electronic circuitry herein employed.

Referring now to FIG. 8 of the drawings whereon is shown the schematic diagram of a preferred form of the electronic circuit used to actuate the squib or primer utilized in the fuzing apparatus. The coil 16 is mounted on the aft end of the mine mechanism and the core 15 is actually the shield which the coil is wrapped around. A condenser 142 is electrically connected across the coil for tuning purposes. Thus, when a magnetic vehicle is in proximity to the mine which has been buried, the flux sensed by coil 16 will be varied and will generate a voltage of constant frequency across seismic switch 25 which is connected in parallel thereto. With armature 105 resting on contact 103, as shown in the drawings, the voltage generated by search coil 16 cannot be supplied the first stage of the amplifier. However, when both a magnetic field and a vibration source are in proximity to the mine, contact 105 of vibration switch will oscillate, thereby causing a voltage to be applied to the tube 145 of the a.c. amplifying circuit when the switch is open.

Blocking condenser 143 connects the search coil and vibration switch to the grid 147 which is also connected to ground by means of grid leak resistor 144. Cathode 146 of vacuum tube 145 is connected to ground 141 by way of impact switch 23 and screen grid 148 is coupled to battery 151 by way of biasing resistor 153 and is connected to ground by way of biasing condenser 155. The anode 149 is also coupled to battery 151 by way of another resistor 154.

The output of tube 145 is coupled to control grid 159 of tetrode 158 by way of a coupling capacitor 156. Capacitor 156 is charged by grid current and acts to limit the grid voltage in grid 159 so that weak signals from the output of tube 145 will be amplified the same amount as strong signals. The control grid 159 is connected to ground by way of grid leak resistor 157 and cathode 161 is coupled to ground by way of impact switch 23. The screen grid 162 biasing circuit comprises resistor 165 which is connected to the positive terminal battery 151 and condenser 164 which is connected to ground. Battery 151 is connected to the anode 163 of tube 158 by way of primary winding 167 of step up transformer 166.

An electromagnetic signal is applied to the grid of the first stage of this two stage electronic amplifier whenever switch 105 opens. An output signal from the first stage drives tetrode 158 to saturation every time switch 105 opens and closes. The second stage input signal is amplified and limited by the second stage so that constant amplitude pulses having periods equal to the vibration rate of armature 105, will be fed to the primary 167 of transformer 166. A pulse will be produced only when armature 105 is between contacts 103 and 104 of the vibrations responsive switch and disengaged therefrom. Accordingly, the number of pulses which occur will be proportional to the speed at which a vehicle is approaching the mine. Since contact 105 will oscillate at a high frequency for a fast moving vehicle, more pulses will be produced with a fast moving vehicle than with a slow moving vehicle.

A condenser 169 shunts the secondary winding 168 of the transformer 166 to prevent spurious oscillations, which might result when the pulses are applied to the transformer, from reaching tube 183. The secondary winding of the transformer 166 is connected across a coupling capacitor 172 and diode 173. Diode 173 is poled in such a direction as to permit the passage of negative current therethrough but prevent the flow of positive current through it. Diode 174 is connected between diode 173 and condenser 172 and is arranged so that only positive signals can be applied to the parallel combinations of resistor 175 and condenser 176. The positive terminal of battery 151 is connected to the other side of resistor 175, to the anode of diode 173 and to one end of the secondary winding of transformer 68. Thus, only positive pulses will be fed into a shaping circuit 177 from rectifying circuit 171. Capacitor 176 accumulates rectified voltage pulses appearing across resistor 175.

Pulse shaper 177 comprises what is commonly referred to as an integrating and differentiating network for providing a sharp voltage pulses to thyratron 183 to better locate its firing point. The integrating network comprises a resistor 178, which is connected to capacitor 176, and capacitor 179 connected beteeen resistor 178 and ground. The differentiating circuit includes capacitor 182 which is connected between capacitor 176 and the grid 185 of thyratron tube 183. The differentiating circuit also contains a resistor 181 which is connected between capacitors 182 and 179. When a pulse is produced by the rectifying circuit it is supplied to the integrator where it builds up the charge of capacitor 179 slowly and smoothly. Thus, it should be apparent that the build up on capacitor 179 will be dependent upon the number of pulses that are produced which is accordingly responsive to the vibration rate of the armature of switch 25.

Each pulse produced by rectifying circuit 171 is also immediately applied to the grid 185 of the thyratron tube by way of capacitor 182. When the charge on capacitor 179 has built up near the firing potential of the thyratron tube, the next pulse from the rectifying circuit 171 will be differentiated by capacitor 182 and resistor 181 supplying a sharp trigger pulse voltage across resistor 181 which will fire the thyratron. In this manner rectified pulses are shaped to form a firing impulse.

If a vehicle is approaching the mine at a slow rate of speed the voltage build up across the capacitor 179 will likewise be slow, resulting in a long period of time before thyratron 183 fires. However, if a vehicle is travelling fast, contact 105 will oscillate at a considerable rate and there will be a fast voltage buildup on the grid of the thyratron tube. Thus, the circuit can be designed so that the thyratron will fire when the vehicle is directly above the mine regardless of the target speed.

The thyratron circuit comprises a resistor 189 which is connected between anode 186 and the positive terminal of battery 152. The anode of the thyratron tube 183 is coupled to capacitor 188 which is connected to ground by way of impact switch 23. The cold cathode 184 of the gas tube is connected directly to one terminal of explosive primer 187, the other terminal of which is connected to ground. The normally closed inertial safety switch 34, which was previously described, is connected in shunt with capacitors 188 and primer 187. This component prevents primer 187 from conducting current and exploding and likewise prevents voltage buildup of capacitor 188 until the switch 34 is opened. The armatures 34 and 34' of the inertial safety switch may be either wires from a single switch or a pair of switches.

When the mine vehicle strikes the ground, impact switches 23 and 23' will be closed and inertial safety switches 34 and 34' will be opened, thereby actuating the two stage amplifier and passing through condenser 188. Thus, a voltage buildup will be produced across the anode 186 of the thyratron permitting actuation of primer 187 when the voltage on the grid 185 is of sufficient magnitude to render the thyratron conductive. Most of the charge which had been stored in capacitor 188 will be dissipated through the thyratron in series with the squib or primer 187 when the thyratron is rendered conductive. The squib will explode, thereby actuating booster 49 shown in FIG. 2. The booster will explode causing detonation of the explosive material contained in the main portion of the mine.

Many modifications of this invention should be apparent to those skilled in the art. For instance, seismic or vibration responsive switch 25 could be placed in series with the coil 16 rather than in parallel therewith. Also the switch may be in the normally opened or closed position, whichever is desired.

There has herein been disclosed a new and improved vibration and magnetic field responsive mine. For actuation of the mine it is necessary that both of these influences be present. This invention is accomplished by way of unique seismic or vibration switches as well as new and improved inertial safety switches which are utilized in a new electronic actuation circuit.

It will be understood that various changes in the details, materials, steps and arrangement of parts, which have been herein described and illustrated in order to explain the nature of the invention, may be made by those skilled in the art within the principles and scope of the invention as expressed in the appended claims.

What is claimed is:

1. A detonating circuit comprising a coil responsive to an external magnetic field, a vibration responsive switch connected in parallel with said coil having a closed position and an open position, said switch responsive to external vibration for vibrating between said open and closed positions, an electronic amplifier coupled to said switch and to said coil and biased to provide constant amplitude pulses having periods equal to the vibration rate of said switch, an impulse forming circuit coupled to said amplifier having means for storing a predetermined number of said pulses, an explosive primer, means coupled to said impulse forming circuit and to said primer for actuating said primer when an impulse of predetermined energy is generated in response to the receipt of said predetermined number of pulses.

2. The circuit of claim 1 wherein said impulse forming circuit includes a rectifier circuit coupled to the output of said amplifier, and a pulse shaping network connected between said rectifier circuit and said primer actuating means, said shaping network including differentiating and integrating networks.

3. The circuit of claim 1 wherein said primer actuating means includes a capacitor, a thyratron having a control grid connected to said influence forming circuit, a cathode connected to said primer, and an anode connected to said condenser, and a power supply connected to the anode of said thyratron and to said condenser.

4. An electronic circuit comprising a coil responsive to an external magnetic field, a normally closed vibration responsive switch connected in parallel with said coil, an amplifier connected to said switch, a rectifying circuit coupled to the output of said amplifier, a pulse shaping network connected to said rectifying circuit and a load coupled to said network.

5. A detonating circuit comprising a coil responsive to an external magnetic field, a vibration responsive switch connected in parallel with said coil, a two stage electronic amplifier and limiter connected to said switch, a rectifying circuit coupled to said amplifier, a pulse shaping network having differentiating and integrating circuits coupled to said rectifying circuit, a thyratron having a control grid connected to said network, an explosive primer connected to the cathode of said thyratron, a capacitor connected to the anode of said thyratron, and a power supply connected to said capacitor and to the anode of said thyratron, a pair of normally closed inertial switches, one of said inertial switches connected in parallel with said primer, and the other of said inertial switches connected in parallel with said capacitor, and a pair of normally open impact switches one of said impact switches connected to said amplifier to render said amplifier inoperative until said one impact switch is actuated, the other of said impact switches connected between said capacitor and said power supply.

6. An air-dropped land mine comprising means for detecting a magnetic field external to the mine, means connected to said detecting means for amplifying the output of said detecting means, a switch responsive to external vibrations connected is shunting relationship across said detecting means whereby the output of said detecting means is intermittently applied to said amplifying means at a frequency equal to the frequency of vibration of said vibration responsive switch, and means connected to the output of said amplifying means and responsive to a predetermined number of output pulses from said amplifying means for detonating the explosive of the mine said detonating means having a rectifying circuit coupled to the output of said amplifying means and a pulse shaping network connected to said rectifying circuit.

7. A land mine as defined in claim 6 wherein inertial switch means are included in said amplifying means for rendering said amplifying means operative when the mine strikes the ground.

8. A land mine for destroying a moving vehicle comprising means to detect the presence of a magnetic field produced by the vehicle, a switch responsive to vibrations having a frequency proportional to the speed of the vehicle connected in shunting relationship with said detecting means, an explosive train actuator having impulse producing means for producing an impulse of predetermined energy to actuate the explosive train only when the vehicle passes over the mine, said impulse producing means including a signal amplifier and a limiter circuit connected to said switch, a signal rectifier coupled to said circuit, and pulse integrating and differentiating networks coupled to said rectifying means.

* * * * *